US009738473B2

(12) United States Patent
Iizuka

(10) Patent No.: US 9,738,473 B2
(45) Date of Patent: Aug. 22, 2017

(54) SHEET DETECTING APPARATUS, SHEET CONVEYING APPARATUS, AND IMAGE FORMING APPARATUS

(71) Applicant: CANON KABUSHIKI KAISHA, Tokyo (JP)

(72) Inventor: Yoichiro Iizuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/969,470

(22) Filed: Dec. 15, 2015

(65) Prior Publication Data

US 2016/0101956 A1 Apr. 14, 2016

Related U.S. Application Data

(62) Division of application No. 14/362,688, filed as application No. PCT/JP2013/052782 on Jan. 31, 2013, now Pat. No. 9,242,823.

(30) Foreign Application Priority Data

Feb. 8, 2012 (JP) ..... 2012-025191

(51) Int. Cl.
*B65H 7/02* (2006.01)
*B65H 7/14* (2006.01)
(Continued)

(52) U.S. Cl.
CPC ..... *B65H 7/14* (2013.01); *B65H 3/24* (2013.01); *B65H 5/062* (2013.01); *B65H 5/068* (2013.01);
(Continued)

(58) Field of Classification Search
CPC ... B65H 7/02; B65H 7/08; B65H 7/14; B65H 9/004; B65H 9/06; B65H 2553/40;
(Continued)

(56) References Cited

U.S. PATENT DOCUMENTS 5,042,790 A * 8/1991 Miller ..... B65H 7/02 271/110
5,882,130 A * 3/1999 Kumazaki ..... B65H 7/02 271/265.01

(Continued)

FOREIGN PATENT DOCUMENTS

EP 0782967 A1 7/1997
JP 09-183539 A 7/1997

OTHER PUBLICATIONS

International Search Report issued in International Application No. PCT/JP2013/052782 dated May 10, 2013.
International Preliminary Report on Patentability issued in counterpart International Application No. PCT/JP2013/052782, dated Aug. 21, 2014.

*Primary Examiner* — Prasad Gokhale
(74) *Attorney, Agent, or Firm* — Fitzpatrick, Cella, Harper & Scinto

(57) ABSTRACT

A sheet detecting apparatus including: a detection unit including a lever member having an abutment surface abutting a conveying sheet and a holding member configured to hold the lever member, the detection unit moved by the lever member pushed by the sheet; a first urging portion configured to urge the holding member to a waiting position after the sheet is separated from the abutment surface; a support portion configured to support the lever member movable with respect to the holding member to move the lever member to a retracted position for allowing the sheet to pass the lever member contacting a surface of the sheet when the holding member is in the waiting position; and a second urging portion configured to urge the lever member so that the lever member is moved from the retracted position to a position in which the abutment surface abuts a succeeding sheet.

13 Claims, 14 Drawing Sheets

(51) Int. Cl.

| | |
|---|---|
| ***B65H 7/08*** | (2006.01) |
| ***B65H 3/24*** | (2006.01) |
| ***B65H 5/06*** | (2006.01) |
| ***B65H 9/06*** | (2006.01) |

(52) U.S. Cl.
CPC ..... *B65H 7/08* (2013.01); *B65H 9/06* (2013.01); *B65H 2403/531* (2013.01); *B65H 2511/20* (2013.01); *B65H 2511/514* (2013.01); *B65H 2513/53* (2013.01); *B65H 2553/612* (2013.01)

(58) Field of Classification Search
CPC ..... B65H 2553/41; B65H 2553/412; B65H 2553/414; B65H 2553/60; B65H 2553/61; B65H 2553/612; B65H 5/068; B65H 3/24; B65H 2511/514
See application file for complete search history.

(56) References Cited

U.S. PATENT DOCUMENTS

| | | | | |
|---|---|---|---|---|
| 6,011,948 | A | 1/2000 | Amano et al. | |
| 6,292,636 | B1 * | 9/2001 | Kwon | B41J 11/0075 271/10.03 |
| 9,388,005 | B2 * | 7/2016 | Iizuka | B65H 9/004 |
| 2004/0135311 | A1 | 7/2004 | Chambers et al. | |
| 2007/0147919 | A1 * | 6/2007 | Lim | B41J 11/006 399/388 |
| 2011/0089629 | A1 | 4/2011 | Furusawa et al. | |
| 2013/0264768 | A1 * | 10/2013 | Araishi | B65H 7/02 271/264 |
| 2014/0361483 | A1 * | 12/2014 | Iizuka | B65H 9/004 271/228 |

* cited by examiner

SHEET DETECTING APPARATUS, SHEET CONVEYING APPARATUS, AND IMAGE FORMING APPARATUS

TECHNICAL FIELD

The present invention relates to a sheet detecting apparatus configured to detect a position of a conveyed sheet, a sheet conveying apparatus including the sheet detecting apparatus, and an image forming apparatus including the sheet detecting apparatus.

BACKGROUND ART

In general, in a conventional image forming apparatus, a sheet detecting apparatus configured to detect a position of a leading edge of a sheet is provided on a sheet conveying path so as to synchronize a timing to send the sheet to an image transfer position with a timing to send an image formed by an image forming portion to the image transfer position (PTL 1). The sheet detecting apparatus is also usable for detecting a sheet conveying status on the sheet conveying path, such as a sheet conveyance delay and a jam.

FIG. 15 illustrates a conventional sheet detecting apparatus 100. As illustrated in FIG. 15, the conventional sheet detecting apparatus 100 is provided on a downstream side in a sheet conveying direction (hereinafter simply referred to as "downstream side") with respect to a pair of conveying rollers 131 and 132, which is located on an upstream side in the sheet conveying direction (hereinafter simply referred to as "upstream side") so as to be closest to the image transfer position. The sheet detecting apparatus 100 includes a lever member 173 which abuts against a sheet S, an optical sensor 175*b*, a light blocking flag 175*a* configured to block an optical path from a light emitting portion to a light receiving portion of the optical sensor 175*b*, and a stopper 176 configured to position the lever member 173 in a waiting position. The lever member 173 is configured to be rotatable about a rotary shaft 173*c*, and to return, after the rotation, to the waiting position by a pressing force of a return spring 174. The light blocking flag 175*a* is formed integrally with the lever member 173, and rotates together with the lever member 173.

As illustrated in FIGS. 16A and 16B, when a leading edge of the sheet S abuts against the lever member 173, the lever member 173 rotates about the rotary shaft 173*c* from a home position HP in a direction indicated by the arrow in FIG. 16B, and the light blocking flag 175*a* blocks the optical path of the optical sensor 175*b*. When the optical sensor 175*b* detects that the optical path is blocked, the sheet detecting apparatus 100 recognizes that the leading edge of the sheet S reaches the lever member 173. After that, the sheet S pushes the lever member 173, and the lever member 173 rotates accordingly, with the result that the sheet S is allowed to move. When a trailing edge of the sheet S is separated from the lever member 173, the lever member 173 is rotated by the return spring 174 in a direction opposite to the direction indicated by the arrow in FIG. 16B, to thereby return to the home position HP. At this time, the light blocking flag 175*a* retracts from the optical path, and the light receiving portion of the optical sensor 175*b* again receives the light emitted from the light emitting portion thereof, with the result that the sheet detecting apparatus 100 recognizes that the trailing edge of the sheet S has passed the lever member 173.

By the way, in recent years, much higher throughput (number of sheets subjected to image formation per unit time) of an image forming apparatus has been demanded. In order to meet this demand, it has been required to convey sheets at a higher speed, and reduce a distance between a trailing edge of a preceding sheet and a leading edge of a succeeding sheet (hereinafter referred to as "sheet-to-sheet distance"). In accordance therewith, it is necessary for the lever member to be returned to the home position HP within a short sheet-to-sheet distance.

On the other hand, when the leading edge of the sheet S which has passed through the pair of conveying rollers 131 and 132 abuts against an abutment surface 173*a* of the conventional lever member 173, the lever member 173 is pushed by the sheet S to rotate, and when the trailing edge of the sheet S is separated from the abutment surface 173*a*, the lever member 173 reversely rotates to return to the home position HP. Therefore, a distance required as the sheet-to-sheet distance is a total distance of a distance D1 from a position in which the trailing edge of the preceding sheet has passed the abutment surface 173*a* of the lever member 173 to the home position HP in which the leading edge of the succeeding sheet abuts against the abutment surface 173*a*, and a distance D2 required for conveying the succeeding sheet to the home position HP while the lever member 173 is returned to the home position HP (FIG. 16C). The lever member 173 performs reciprocating rotation, and hence the distance D1 is generated so as to return the lever member 173 to the home position HP after the sheet S passes the lever member 173, and the lever member 173 takes a time $\Delta T$ for moving the distance D1. On the other hand, the distance D2 is a distance ($\Delta T \times V$) obtained by multiplying the time $\Delta T$ during which the lever member 173 moves the distance D1 by a conveying speed V of the sheet S. As the conveying speed V of the sheet S becomes higher, the distance becomes longer. Therefore, in the conventional sheet detecting apparatus 100, when the conveying speed V of the sheet S is increased, the sheet-to-sheet distance needs to be set longer, and hence further enhancement of the throughput is practically impossible. Thus, in the apparatus configured to detect the sheet by using the lever, enhancement of throughput of the sheet conveyance has been limited due to a time period for returning the lever.

CITATION LIST

Patent Literature

PTL 1: Japanese Patent Application Laid-Open No. H09-183539

SUMMARY OF INVENTION

In view of the circumstances, the present invention provides a sheet detecting apparatus configured to enhance throughput, a sheet conveying apparatus including the sheet detecting apparatus, and an image forming apparatus including the sheet detecting apparatus.

According to the present invention, there is provided a sheet detecting apparatus configured to detect a sheet on a sheet conveying path on which the sheet is conveyed, the sheet detecting apparatus comprising: a detection unit including a lever member having an abutment surface against which a leading edge of the sheet being conveyed on the sheet conveying path abuts, and a holding member configured to hold the lever member, the lever member and the holding member being configured to move integrally with each other when the lever member is pushed by the leading edge of the sheet being conveyed, a detection sensor configured to output a signal corresponding to a position of the detection unit, a first urging portion configured to urge the holding member so as to move the holding member to a waiting position after the lever member and the holding member integrally move with each other by the sheet being conveyed; a movable support portion configured to support the lever member in a manner that the lever member is movable with respect to the holding member so that the lever member is located in a retracted position in which the lever member allows the sheet to pass the lever member in contact with a surface of the sheet being conveyed in a state in which the holding member is located in the waiting position; and a second urging portion configured to urge the lever member in a manner that the lever member is moved from the retracted position to a position in which the abutment surface of the lever member abuts against a leading edge of a succeeding sheet as a trailing edge of the sheet passes the lever member.

According to the present invention, higher throughput can be obtained.

Further features of the present invention will become apparent from the following description of exemplary embodiments with reference to the attached drawings.

DESCRIPTION OF EMBODIMENTS

In the following, an image forming apparatus according to an embodiment of the present invention will be described with reference to the drawings. The image forming apparatus according to the embodiment of the present invention is an image forming apparatus such as a copier, a printer, a facsimile machine, and a multifunction peripheral combining those machines, the image forming apparatus including a sheet conveying portion including a sheet detecting portion serving as a sheet detecting apparatus, which is configured to detect a position of a conveyed sheet. In the following embodiments, the image forming apparatus will be described, taking an electrophotographic color image forming apparatus (hereinafter simply referred to as "image forming apparatus") 1 configured to form toner images of four colors as an example.

First Embodiment

Figure 1:
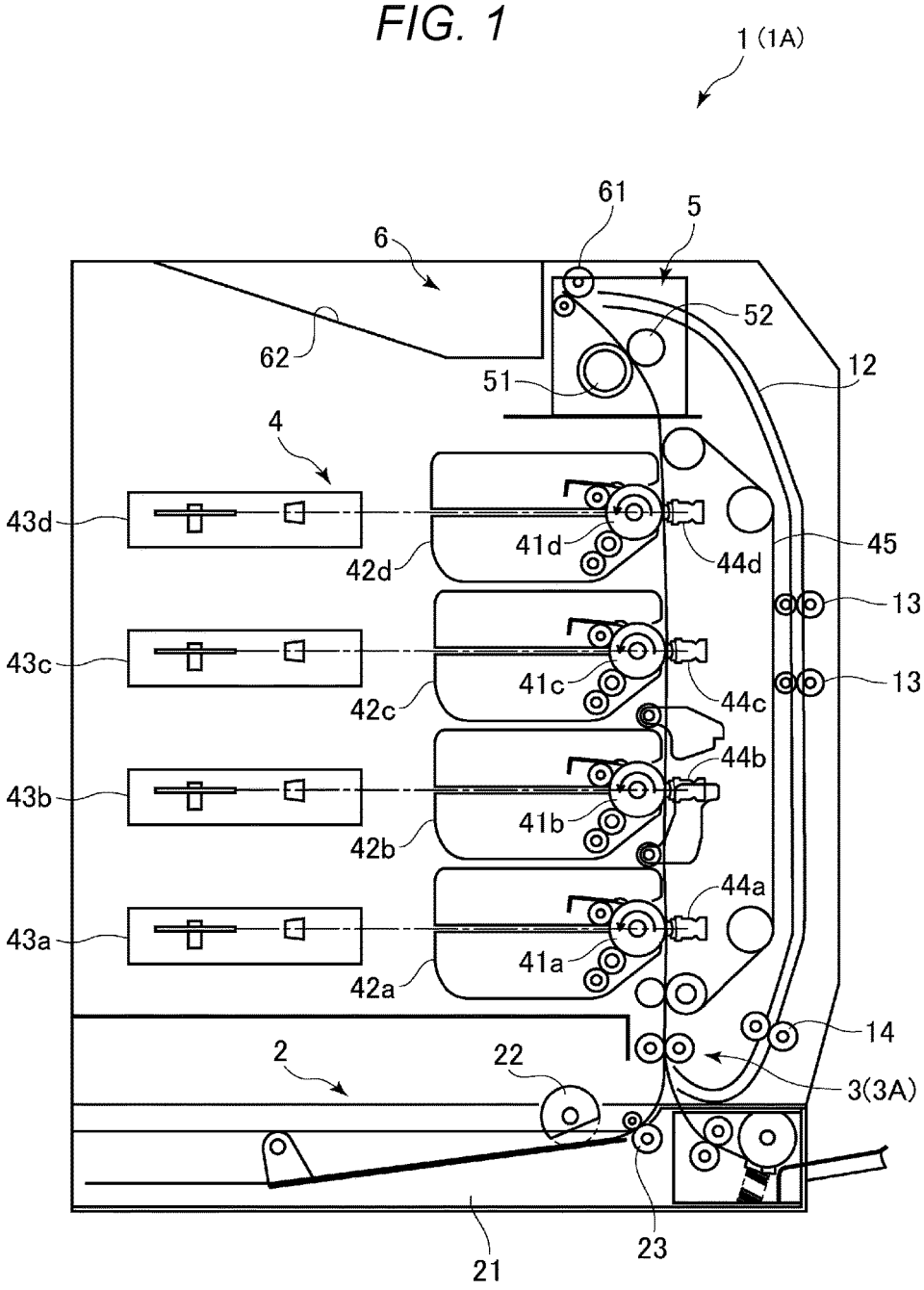
FIG. 1 is a schematic sectional view of an overall structure of an image forming apparatus according to an embodiment of the present invention.

The image forming apparatus 1 according to a first embodiment of the present invention will be described with reference to FIGS. 1 to 9B. First, an overall structure of the image forming apparatus 1 according to the first embodiment will be described with reference to FIG. 1. FIG. 1 is a schematic sectional view of the overall structure of the image forming apparatus 1 according to the embodiment of the present invention.

As illustrated in FIG. 1, the image forming apparatus 1 according to the first embodiment includes a sheet feeding portion 2 configured to feed a sheet S, a sheet conveying portion 3 configured to detect a leading edge position of the sheet S, and an image forming portion 4 configured to form an image on the sheet S conveyed from the sheet conveying portion 3. Further, the image forming apparatus 1 includes a fixing portion 5 configured to fix an unfixed image, which is formed by the image forming portion 4, onto the sheet S, and a delivery portion 6 configured to deliver the sheet S on which the image is fixed.

The sheet feeding portion 2 is arranged in a lower portion of the image forming apparatus 1, and includes a detachable sheet containing portion 21 configured to contain the sheets S and a pick-up roller 22 configured to send the sheets S contained in the sheet containing portion 21. The sheet feeding portion 2 includes a separating portion 23 configured to separate one by one the sheets S sent by the pick-up roller 22. The sheet conveying portion 3 is arranged downstream of the sheet feeding portion 2 in a sheet conveying direction, and includes a sheet detecting portion 7 configured to detect the leading edge position of the conveyed sheet S. Note that, the sheet conveying portion 3 will be described in detail later.

The image forming portion 4 is arranged downstream of the sheet conveying portion 3, and includes photosensitive drums 41*a*, 41*b*, 41*c*, and 41*d* on which toner images of yellow, magenta, cyan, and black are respectively formed, and exposure devices 43*a*, 43*b*, 43*c*, and 43*d* configured to form electrostatic latent images respectively on surfaces of the photosensitive drums 41*a* to 41*d*. Further, the image forming portion 4 includes process cartridges 42*a*, 42*b*, 42*c*, and 42*d* configured to respectively develop the electrostatic latent images formed by the exposure devices 43*a* to 43*d* into toner images, transfer portions 44*a*, 44*b*, 44*c*, and 44*d* configured to respectively transfer the toner images onto the sheet S, and a transfer belt 45 configured to convey the sheet S. The photosensitive drums 41*a* to 41*d* are arranged to be rotatable by motors (not shown). The process cartridges 42*a* to 42*d* each include a charger, a developing device, and a cleaner in one unit. The charger, the developing device, and the cleaner are arranged respectively around each of the photosensitive drums 41*a* to 41*d*. The transfer portions 44*a* to 44*d* are disposed inside of the transfer belt 45 so as to be respectively opposed to the photosensitive drums 41*a* to 41*d*. The transfer belt 45 is driven to be rotated so that the sheet S is moved sequentially to the transfer portions 44*a* to 44*d*.

The fixing portion 5 is arranged downstream of the image forming portion 4, and includes a fixing roller 51 with built-in heater and a pressure roller 52 which is in pressure contact with the fixing roller 51. The delivery portion 6 is arranged downstream of the fixing portion 5, and includes a delivery roller pair 61 configured to deliver the sheet S to an outside of the image forming apparatus, and a delivery tray 62 configured to stack the sheets S delivered to the outside of the image forming apparatus.

Next, an image forming process of the image forming apparatus 1 according to the first embodiment structured as described above will be described. When an image forming operation is started, first, the sheets S contained in the sheet containing portion 21 are sent to the sheet conveying portion 3 located on the downstream side while being separated one by one by the pick-up roller 22 and the separating portion 23. The leading edge of each sheet S sent to the sheet conveying portion 3 is detected by the sheet detecting portion 7. The sheet S is then conveyed to the image forming portion 4 located downstream of the sheet conveying portion 3.

When the leading edge of the sheet S is detected, the image forming portion 4 starts the image forming operation based on image information input from a personal computer (not shown). Specifically, based on the image information input from the personal computer (not shown), first, the exposure device 43*a* radiates a laser beam according to an image signal corresponding to a yellow color component of an original to the photosensitive drum 41*a* uniformly charged by the charger of the process cartridge 42*a*. In this way, a yellow electrostatic latent image is formed on a surface of the photosensitive drum 41*a*. Then, the yellow electrostatic latent image is developed with a yellow toner contained in the developing device of the process cartridge 42*a* to be visualized as a yellow toner image. Next, by the same method described above, the electrostatic latent images of magenta, cyan, and black are formed respectively on surfaces of the photosensitive drums 41*b* to 41*d*, and those electrostatic latent images are visualized respectively as a magenta toner image, a cyan toner image, and a black toner image.

When the yellow toner image is formed on the photosensitive drum 41*a*, the sheet S conveyed by the sheet detecting portion 7 is sent to the transfer portion 44*a* of the image forming portion 4 at a predetermined timing. When the sheet S is conveyed to the transfer portion 44*a*, the yellow toner image formed on the surface of the photosensitive drum 41*a* is transferred onto the sheet S by transfer bias applied to a transfer charger (not shown). After the yellow toner image is transferred, by the same method described above, the magenta toner image, the cyan toner image, and the black toner image are sequentially transferred in a superimposed manner onto the yellow toner image while the sheet S is conveyed by the transfer belt 45. In this way, a full-color toner image is formed on the sheet S.

The sheet S on which the full-color toner image is transferred is conveyed to the fixing portion 5, and the toners are fused and mixed while being heated and pressurized by the fixing roller 51 and the pressure roller 52. In this way, the full-color toner image is fixed as a full-color image. After that, the sheet S on which the full-color image is fixed is delivered by the delivery roller pair 61 provided downstream of the fixing portion 5 onto the delivery tray 62 arranged in an upper portion of the image forming apparatus 1. With this, the image forming process is completed.

Note that, duplex printing is performed as follows. After an image is fixed to a first side of the sheet S by the fixing portion 5, the delivery roller pair 61 is reversely rotated so that the sheet S is not delivered onto the delivery tray 62 by the delivery roller pair 61 but conveyed in a reversed state into a duplex conveying path 12. The sheet S conveyed into the duplex conveying path 12 is re-conveyed to the sheet conveying portion 3 by skew feed roller pairs 13 and a U-turn roller pair 14. Then, the leading edge of the sheet S is detected by the sheet detecting portion 7 of the sheet conveying portion 3 so that the image forming portion 4 starts to form an image. Then, the sheet S is conveyed to the image forming portion 4 at a predetermined timing, and the image is formed on a second side of the sheet S by the image forming portion 4.

Figure 2A:
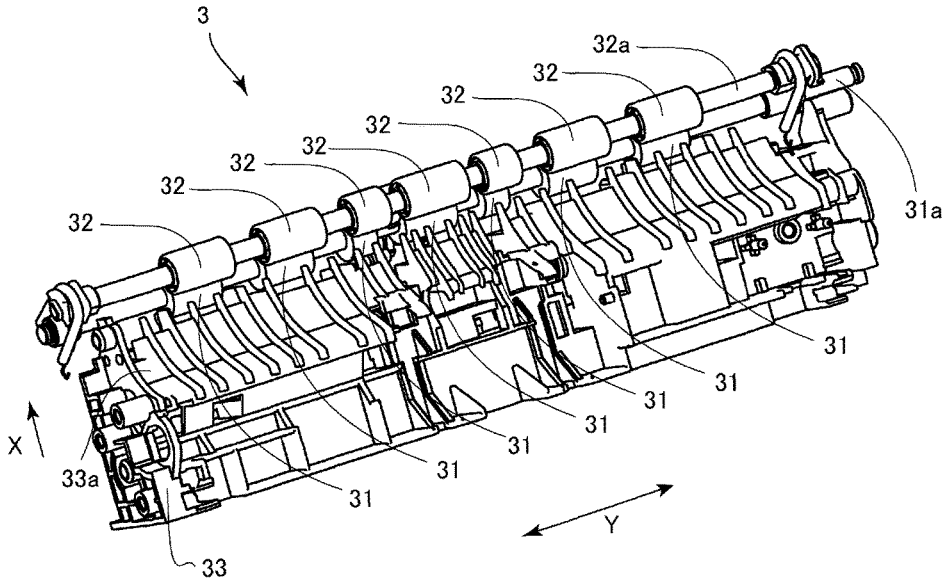
FIG. 2A is a perspective view of a sheet conveying portion according to a first embodiment.
Figure 2B:
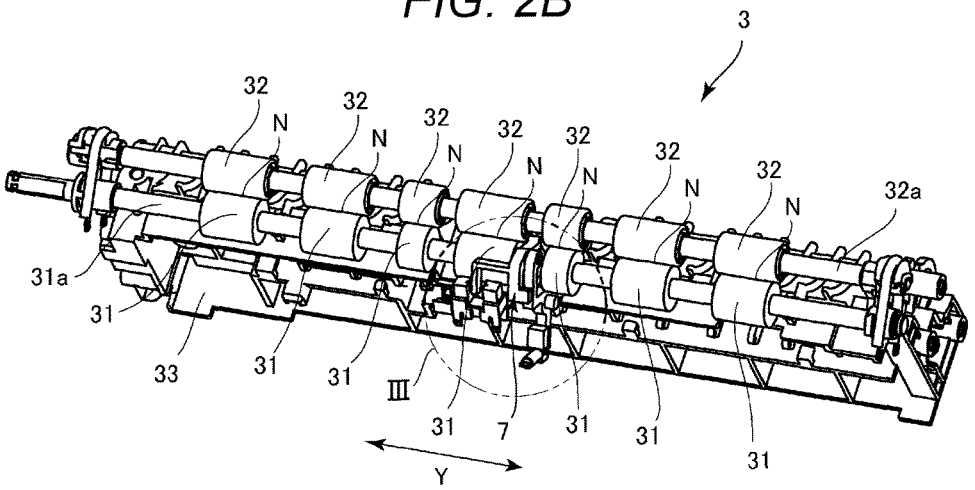
FIG. 2B is a perspective view of the sheet conveying portion illustrated in FIG. 2A as viewed from the opposite side.
Figure 3:
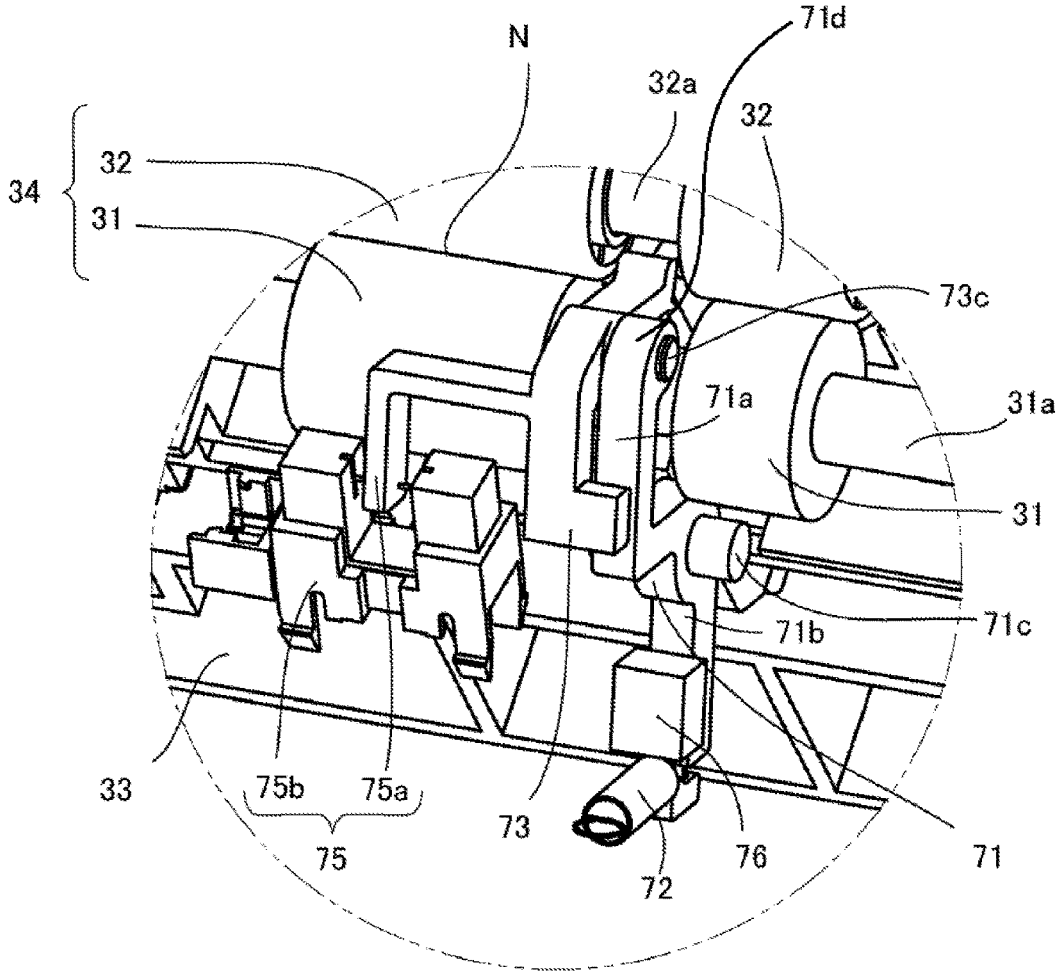
FIG. 3 is an enlarged view of the encircled portion III of FIG. 2B.
Figure 4A:
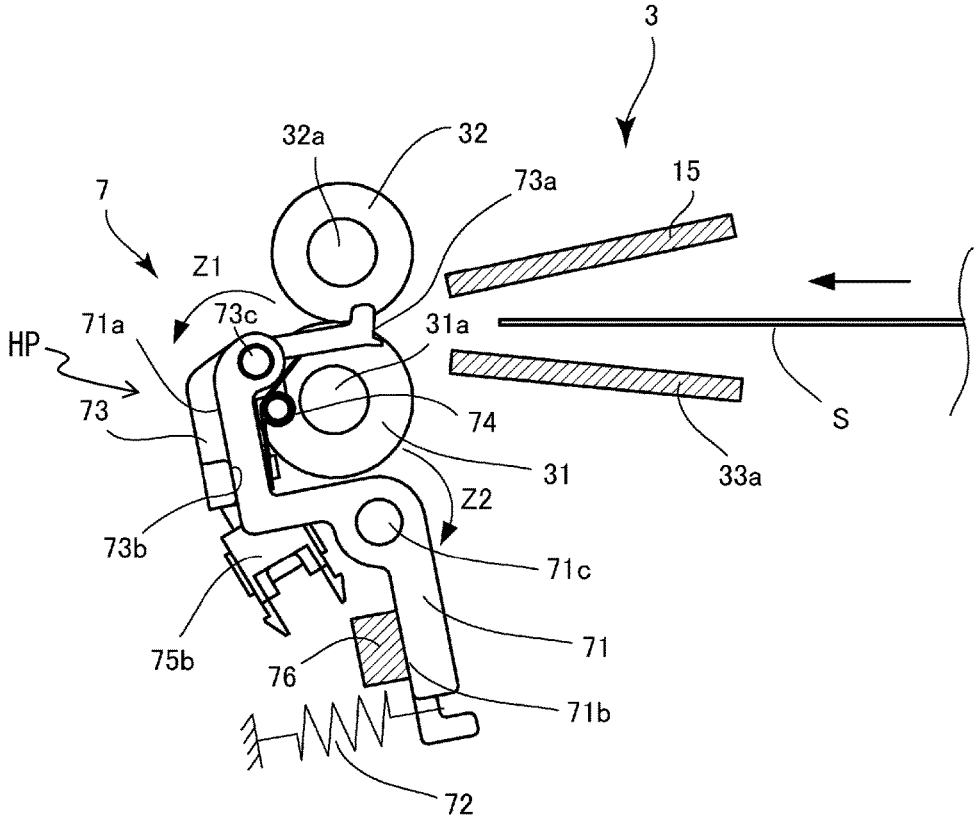
FIG. 4A is a sectional view illustrating a state in which a sheet enters a sheet detecting portion according to the first embodiment.
Figure 4B:
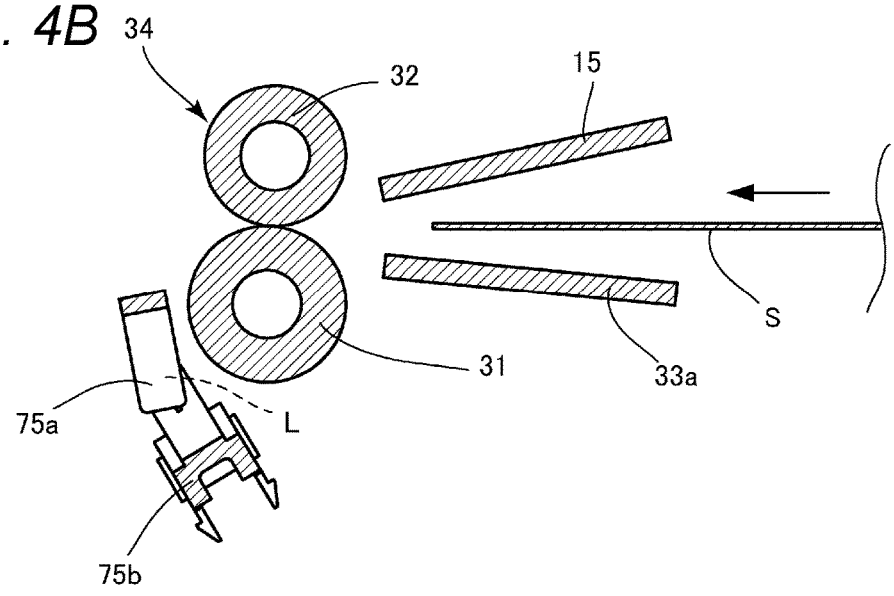
FIG. 4B is a sectional view illustrating a state of a leading edge detecting portion of FIG. 4A.

Next, the sheet conveying portion 3 of the image forming apparatus 1 according to the first embodiment will be described in detail with reference to FIGS. 2A to 9B in addition to FIG. 1. First, an overall structure of the sheet conveying portion 3 will be described with reference to FIGS. 2A to 4B. FIG. 2A is a perspective view of the sheet conveying portion 3 according to the first embodiment. FIG. 2B is a perspective view of the sheet conveying portion 3 illustrated in FIG. 2A as viewed from the opposite side. FIG. 3 is an enlarged view of the encircled portion III of FIG. 2B. FIG. 4A is a sectional view illustrating a state in which the sheet S enters the sheet detecting portion 7 according to the first embodiment. FIG. 4B is a sectional view illustrating a state of a leading edge detecting portion of FIG. 4A.

As illustrated in FIGS. 2A to 4B, the sheet conveying portion 3 includes a plurality of conveying rollers 31, a plurality of conveying rotatable members 32, a feeding frame 33, and the sheet detecting portion 7. As illustrated in FIGS. 2A and 2B, the plurality of conveying rollers 31 are firmly fixed to a roller shaft 31*a*, and the roller shaft 31*a* is rotatably supported by the feeding frame 33 in parallel to a sheet width direction Y orthogonal to a sheet conveying direction X. The plurality of conveying rotatable members 32 are supported to be rotatable about a rotatable member shaft 32*a* so as to be respectively opposed to the plurality of conveying rollers 31. The rotatable member shaft 32*a* is supported by the feeding frame 33 in parallel to the roller shaft 31*a* so that the plurality of conveying rotatable members 32 and the plurality of conveying rollers 31 form respective nips N. Note that, the sheet width direction Y is parallel to a direction of a rotary shaft of each of the photosensitive drums 41*a* to 41*d*. Further, the conveying roller 31 and the conveying rotatable member 32 are hereinafter referred to as a conveying roller pair 34 (see, for example, FIG. 3).

As illustrated in FIGS. 4A and 4B, the feeding frame 33 includes a guide portion 33*a* configured to guide the sheet S in cooperation with a guide frame 15 to the nips N, the guide portion 33*a* being provided upstream of the nips N formed by the plurality of conveying rotatable members 32 and the plurality of conveying rollers 31. In cooperation with the guide frame 15, the guide portion 33*a* regulates both sides in a thickness direction of the sheet S upstream of the nips N, and guides the sheet S to the nips N. Note that, in this embodiment, although the guide frame 15 configured to guide the sheet S to the nips N in cooperation with the guide portion 33*a* is additionally provided, a guide portion configured to guide the sheet S to the nips N in cooperation with the guide portion 33*a* may be provided to the feeding frame 33.

The sheet detecting portion 7 includes a holding member 71 rotatably supported by the feeding frame 33, a first urging spring 72 as a first urging unit configured to urge the holding member 71, and the lever member 73 rotatably held by the holding member 71. Further, the sheet detecting portion 7 includes a second urging spring 74 as a second urging unit configured to urge the lever member 73, a leading edge detecting portion 75 configured to detect the leading edge of the sheet S, and a regulating member (stopper) 76 configured to regulate rotation of the holding member 71. The holding member 71 and the lever member 73 rotatably held by the holding member 71 compose a detection unit.

The holding member 71 is supported by the feeding frame 33 so as to be rotatable about a rotary shaft 71*c* parallel to the roller shaft 31*a*. The holding member 71 includes a regulating surface (regulating portion) 71*a* configured to regulate rotation of the lever member 73, and a striking surface 71*b* configured to strike against the regulating member 76. The regulating surface 71*a* and the striking surface 71*b* are formed on a rear surface side (downstream side) of the holding member 71. The regulating surface 71*a* is formed on one side with respect to the rotary shaft 71*c*, and the striking surface 71*b* is formed on the other side with respect to the rotary shaft 71*c*. The first urging spring 72 has one end connected to the feeding frame 33 and the other end connected to an end portion of the holding member 71 on the other side, and urges the holding member 71 in the direction indicated by the arrow Z2 in FIG. 4A (direction in which the holding member 71 is urged to be located in a first position as a waiting position). The striking surface 71*b* of the holding member 71 strikes against the regulating member 76, and the regulating member 76 therefore regulates the rotation of the holding member 71 so that the holding member 71 is located in the first position as shown in FIG. 4A against the urging force of the first urging spring 72.

The lever member 73 is held by the holding member 71 so as to be rotatable about a rotary shaft 73*c* parallel to the rotary shaft 71*c*, and is movable integrally with the holding member 71. The lever member 73 includes an abutment surface 73*a* against which the leading edge of the sheet S on the sheet conveying path abuts, and a striking surface 73*b* configured to strike against the regulating surface 71*a* of the holding member 71. A movable support portion 71*d* provided on the holding member 71 rotatably supports the rotary shaft 73*c*, and hence the lever member 73 is movably held by the holding member 71. By the rotation of the lever member 73, the abutment surface 73*a* is rotatable between a protruding position, in which the abutment surface 73*a* assumes a protruding state of being located on the sheet conveying path when the holding member 71 is located in the first position, and a retracted position, in which the abutment surface 73*a* retracts from the sheet conveying path toward the holding member. The second urging spring 74 urges the lever member 73 in the direction indicated by the arrow Z1 in FIG. 4A (direction in which the abutment surface 73*a* is located in the protruding position (toward the surface of the sheet)). The striking surface 73*b* strikes against the regulating surface 71*a* of the holding member 71, and the regulating surface 71*a* therefore regulates the rotation of the lever member 73 that is urged by the second urging spring 74 so that the lever member 73 is located in the protruding position against the urging force of the second urging spring 74.

The leading edge detecting portion 75 includes a light blocking flag 75*a* and an optical sensor (photo interrupter) 75*b*, the light blocking flag 75*a* serving as a light blocking portion configured to block an optical path L of the optical sensor 75*b* serving as a detection sensor. As illustrated in FIG. 3, the light blocking flag 75*a* is connected to the lever member 73, and moves together with the lever member 73. The optical sensor 75*b* includes a light emitting portion (not shown) configured to emit light, and a light receiving portion (not shown) configured to receive the light emitted from the light emitting portion. The light emitted from the light emitting portion is received by the light receiving portion so that the optical path L is formed. When the light blocking flag 75*a* blocks the light emitted from the light emitting portion, the light output from the light emitting portion is interrupted, and the light receiving portion does not receive the light. The optical sensor 75*b* detects the movement position of the light blocking flag 75*a* based on the change in state of the light receiving portion, and produces a signal for detecting the position of the sheet S (for example, the position of the leading edge of the sheet S and the passage of the sheet S) through the movement of the light blocking flag 75*a*.

Figure 5A:
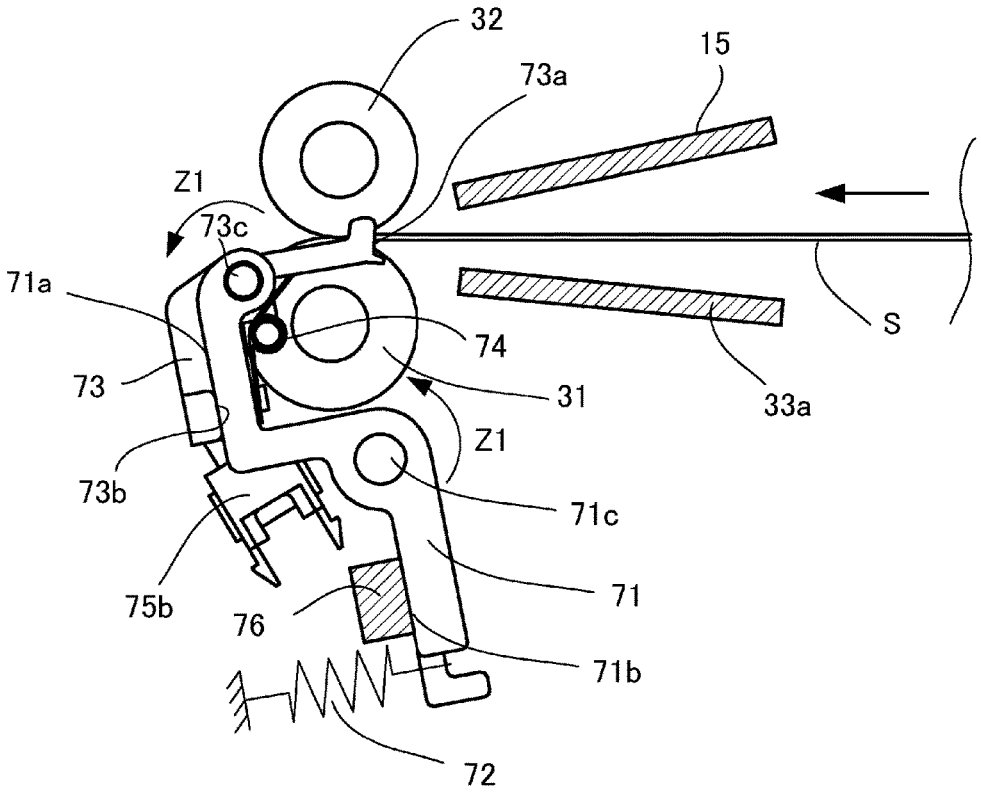
FIG. 5A is a sectional view illustrating a state in which a leading edge of the sheet abuts against an abutment surface of a lever member located in a protruding position.
Figure 5B:
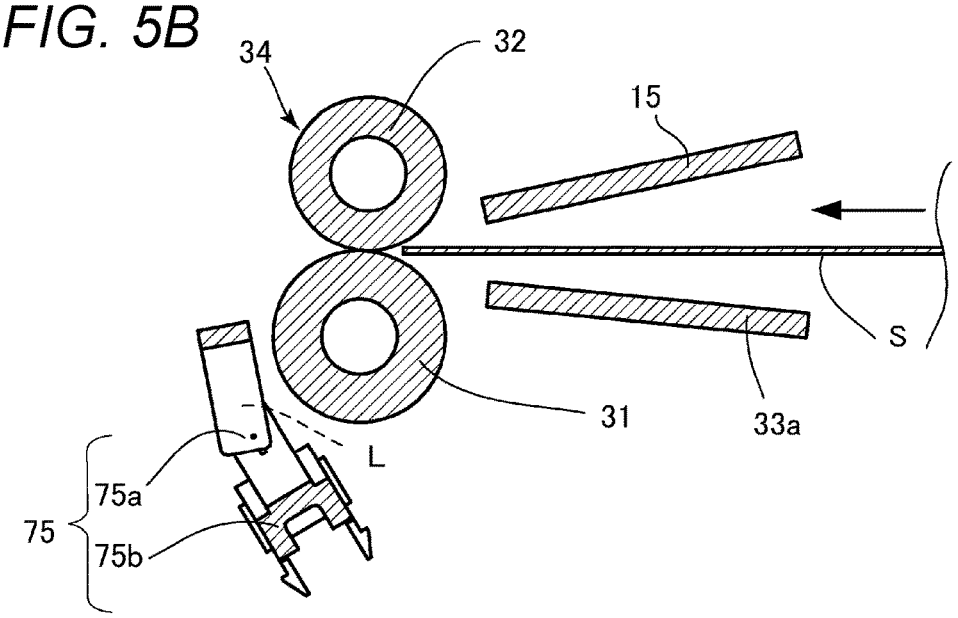
FIG. 5B is a sectional view illustrating a state of the leading edge detecting portion of FIG. 5A.
Figure 6A:
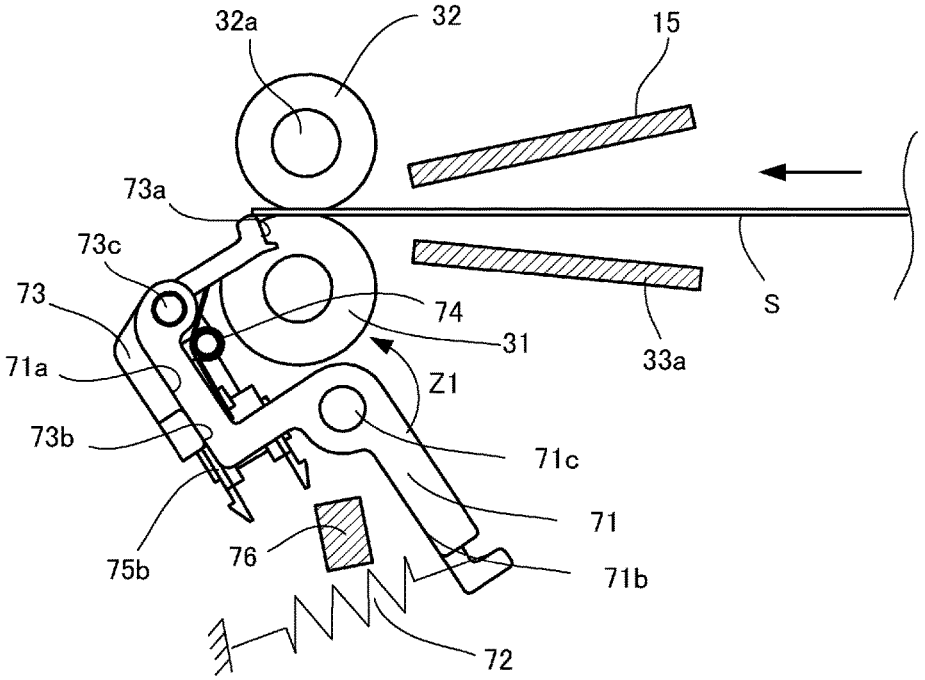
FIG. 6A is a sectional view illustrating a state in which the abutment surface is pushed by the sheet and a holding member configured to hold the lever member is rotated.
Figure 6B:
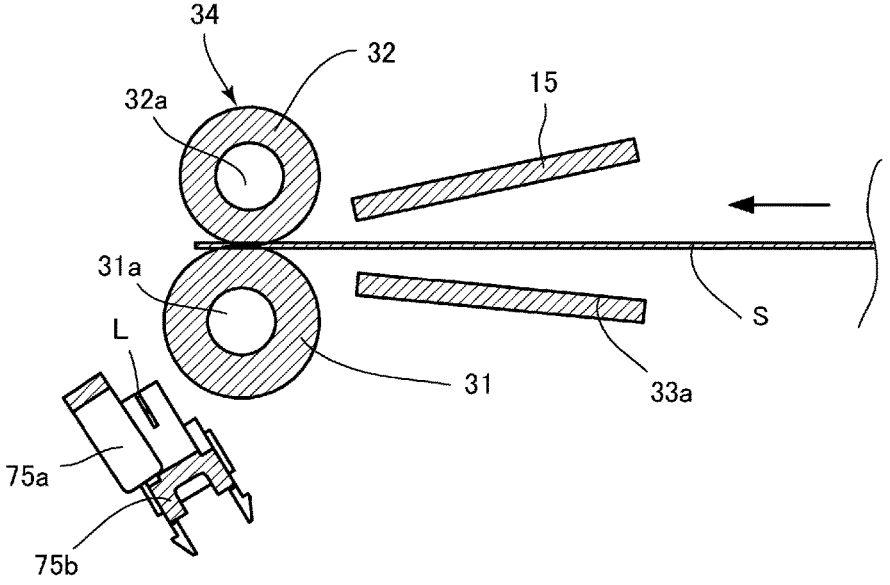
FIG. 6B is a sectional view illustrating a state of the leading edge detecting portion of FIG. 6A.
Figure 7A:
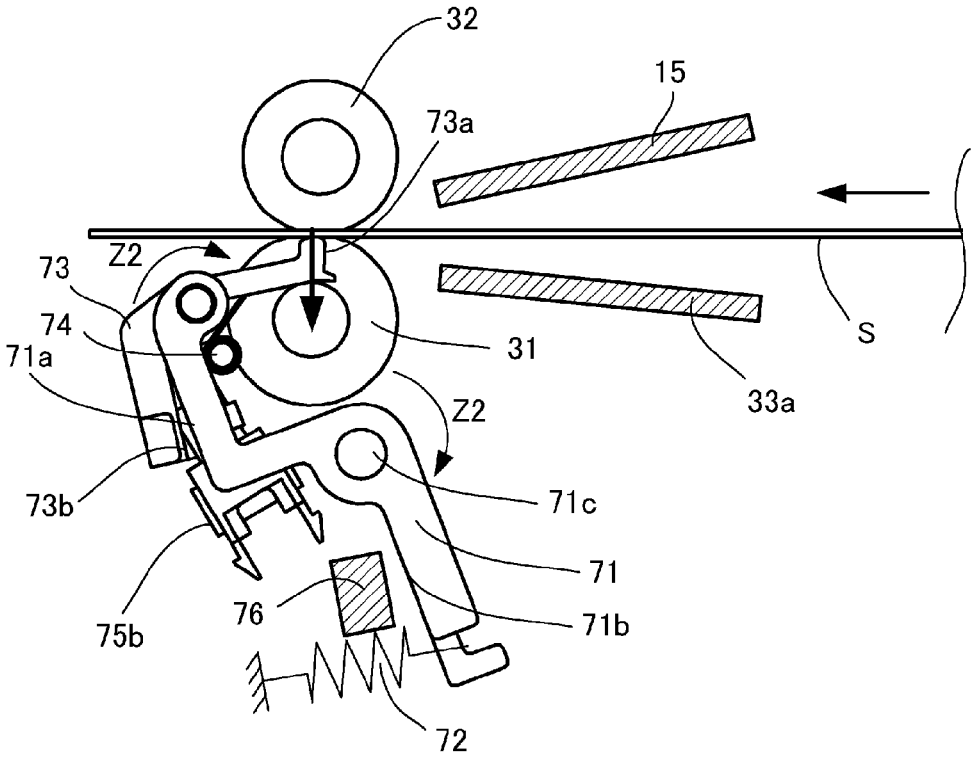
FIG. 7A is a sectional view illustrating a state in which the leading edge of the sheet is disengaged from the abutment surface and the lever member is rotated by a reactive force received from the sheet.
Figure 7B:
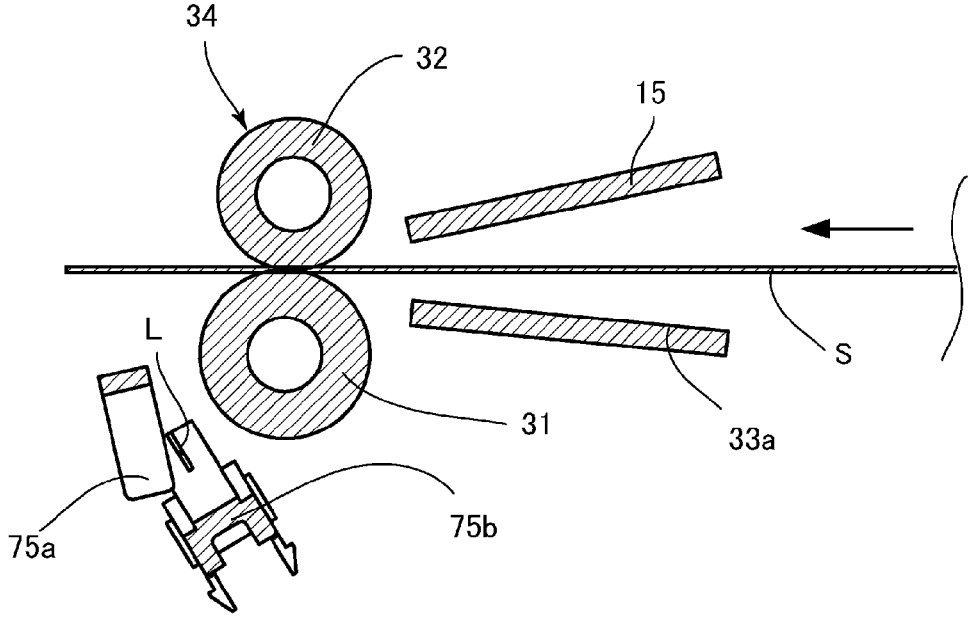
FIG. 7B is a sectional view illustrating a state of the leading edge detecting portion of FIG. 7A.
Figure 8A:
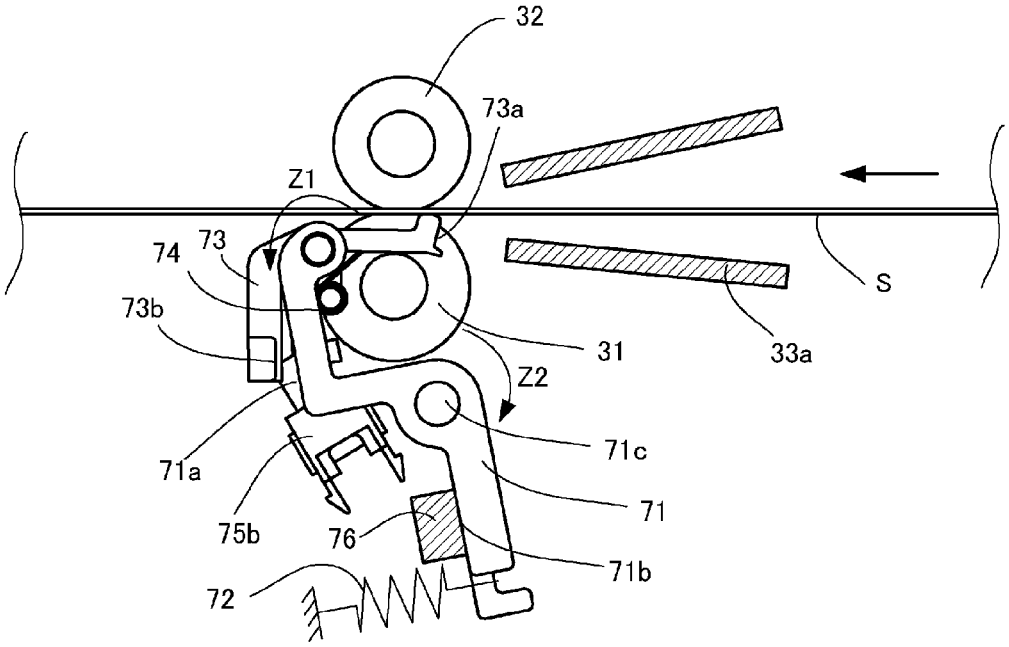
FIG. 8A is a sectional view illustrating a state in which the sheet is passing over the lever member retracted to a retracted position.
Figure 8B:
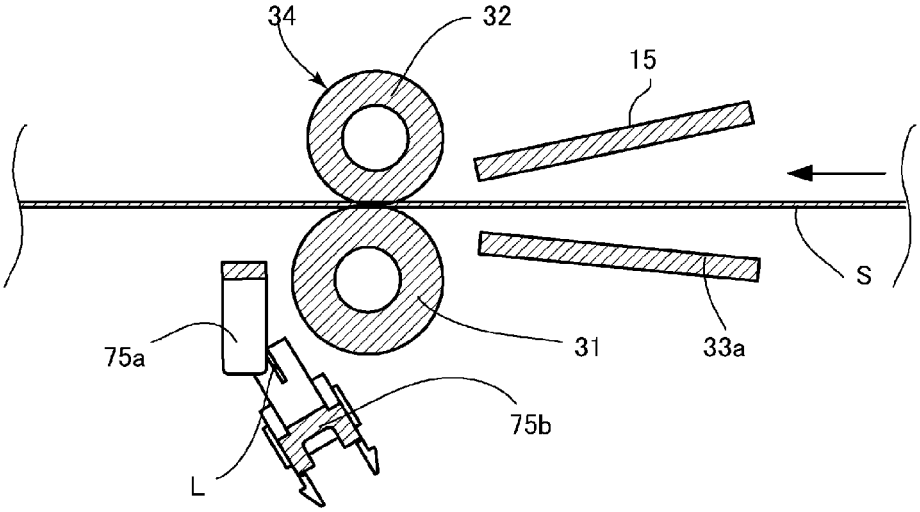
FIG. 8B is a sectional view illustrating a state of the leading edge detecting portion of FIG. 8A.
Figure 9A:
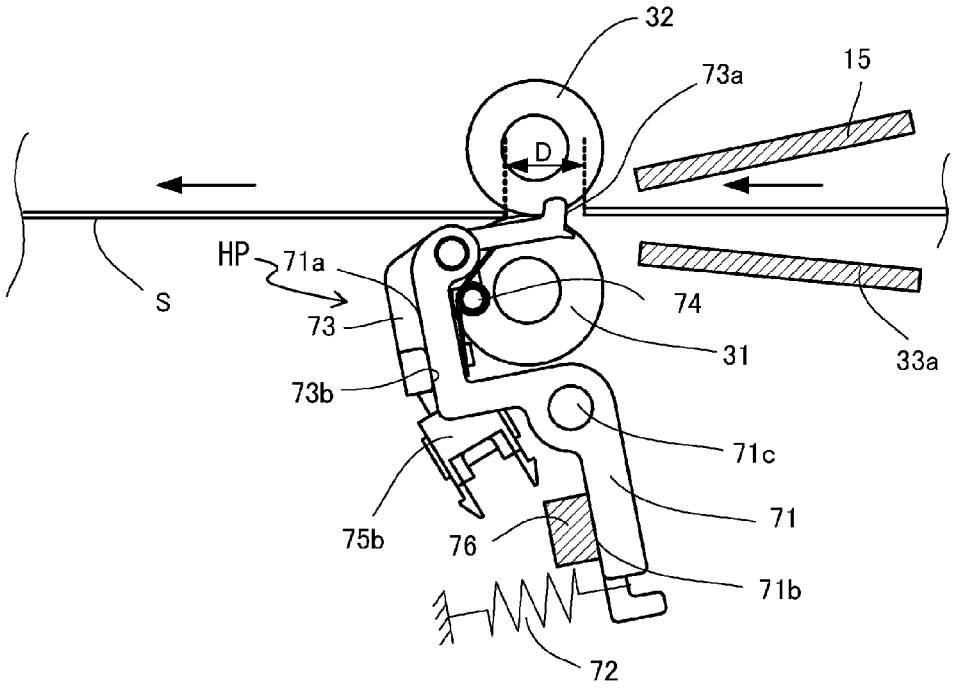
FIG. 9A is a sectional view illustrating a state in which the lever member is returned to the protruding position after the sheet passes a nip.
Figure 9B:
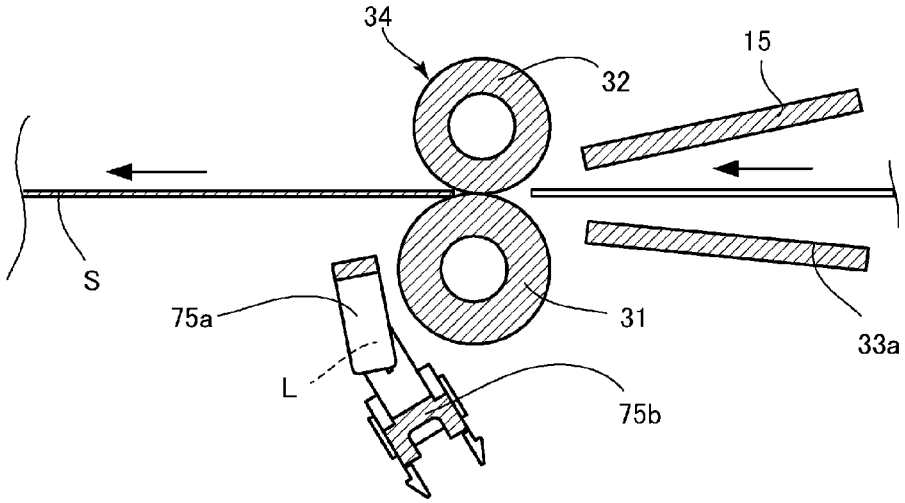
FIG. 9B is a sectional view illustrating a state of the leading edge detecting portion of FIG. 9A.

Next, an operation of detecting the sheet S by the sheet detecting portion 7 according to the first embodiment will be described with reference to FIGS. 5A to 9B in addition to FIGS. 4A and 4B. FIG. 5A is a sectional view illustrating a state in which the leading edge of the sheet S abuts against the abutment surface 73*a* of the lever member 73 located in the protruding position. FIG. 5B is a sectional view illustrating a state of the leading edge detecting portion 75 of FIG. 5A. FIG. 6A is a sectional view illustrating a state in which the abutment surface 73*a* is pushed by the sheet S and the holding member 71 configured to hold the lever member 73 is rotated. FIG. 6B is a sectional view illustrating a state of the leading edge detecting portion 75 of FIG. 6A. FIG. 7A is a sectional view illustrating a state in which the leading edge of the sheet S is disengaged from the abutment surface 73*a* and the lever member 73 is rotated by a reactive force received from the sheet S. FIG. 7B is a sectional view illustrating a state of the leading edge detecting portion 75 of FIG. 7A. FIG. 8A is a sectional view illustrating a state in which the sheet S passes over the lever member 73 retracted to the retracted position. FIG. 8B is a sectional view illustrating a state of the leading edge detecting portion 75 of FIG. 8A. FIG. 9A is a sectional view illustrating a state in which the lever member 73 is returned to the protruding position after the sheet S passes the nips N. FIG. 9B is a sectional view illustrating a state of the leading edge detecting portion 75 of FIG. 9A.

As illustrated in FIG. 4A, in a state before the sheet S fed from the sheet feeding portion 2 enters the sheet conveying portion 3, the holding member 71 is urged by the first urging spring 72, and the striking surface 71*b* strikes against the regulating member 76 so that the holding member 71 is located in the first position. The lever member 73 held by the holding member 71 that is located in the first position is urged by the second urging spring 74, and the striking surface 73*b* strikes against the regulating surface 71*a* of the holding member 71 so that the lever member 73 is located in the protruding position. In the following, this position in a state in which the holding member 71 is located in the first position while the lever member 73 is located in the protruding position is referred to as "home position HP" as the waiting position. When the holding member 71 and the lever member 73 are located in the home position HP, as illustrated in FIG. 4B, the light blocking flag 75*a* blocks the optical path L of the optical sensor 75*b* so that the leading edge detecting portion 75 enters a state in which the light emitted from the light emitting portion is blocked.

As illustrated in FIG. 5A, when the sheet S enters the sheet conveying portion 3 and the leading edge of the sheet S abuts against the abutment surface 73*a* of the lever member 73, the abutment surface 73*a* is pushed by the sheet S and the holding member 71 starts to rotate in the direction indicated by the arrow Z1 in FIG. 5A together with the lever member 73. As illustrated in FIG. 5B, also in this state, the light blocking flag 75*a* blocks the optical path L of the optical sensor 75*b* so that the leading edge detecting portion 75 enters the state in which the light output from the light emitting portion is blocked.

As illustrated in FIG. 6A, when the lever member 73 pushed by the leading edge of the sheet S further rotates together with the holding member 71 and the holding member 71 reaches a second position, the abutment surface 73*a* of the lever member 73 held by the holding member 71 retracts from the sheet conveying path. At this time, the sheet S is nipped by the nips of the conveying roller pairs 34, the sheet S enters a state in which the sheet S is conveyed by the conveying roller pairs 34. In this case, when the holding member 71 moves from the first position together with the lever member 73, as illustrated in FIG. 6B, the light blocking flag 75*a* is separated from the optical path L of the optical sensor 75*b* in association with the movement of the lever member 73. When the light blocking flag 75*a* is separated from the optical path L, the optical path L is unblocked, and accordingly the light receiving portion receives the light output from the light emitting portion. When the light receiving portion receives the light, the optical sensor 75*b* transmits a detection signal to a control portion (not shown), and the control portion controls the image forming portion 4 to start the image forming operation.

When the abutment surface 73*a* of the lever member 73 retracts from the sheet conveying path, the leading edge of the sheet S passes beyond a top point of the abutment surface 73*a* so that the leading edge of the sheet S is disengaged from the abutment surface 73*a*. When the leading edge of the sheet S is disengaged from the abutment surface 73*a*, the lever member 73 receives the reactive force in the direction indicated by the arrow in FIG. 7A (direction to the retracted position) from the sheet S nipped by the nips N of the conveying roller pairs 34. After the lever member 73 receives the reactive force in the direction indicated by the arrow from the sheet S, as illustrated in FIG. 7A, the lever member 73 starts to rotate in the direction indicated by the arrow Z2 against an urging force of the second urging spring 74, in other words, starts to move to the retracted position. Note that, the second urging spring 74 is configured to urge the lever member 73 in the direction indicated by the arrow Z1 with a force smaller than a moment of the reactive force of the sheet S. By receiving the reactive force of the sheet S, the lever member 73 is rotated in the direction indicated by the arrow Z2. Note that, as illustrated in FIG. 7B, also in this state, the light blocking flag 75*a* is separated from the optical path L of the optical sensor 75*b* so that the leading edge detecting portion 75 is still in the state in which the light receiving portion receives the light emitted from the light emitting portion. In this state, the control portion of the image forming apparatus 1 determines that the sheet S is passing through the sheet conveying portion 3.

Further, in accordance with elimination of the pushing force from the sheet S, the holding member 71 starts to rotate in the direction indicated by the arrow Z2 in FIG. 7A toward the first position by the urging force of the first urging spring 72. In accordance with the movement of the holding member 71 in the direction indicated by the arrow Z2, the lever member 73 is moved further to the retracted position while abutting against the surface of the sheet S. Then, as illustrated in FIG. 8A, when the holding member 71 returns to the first position, the lever member 73 is regulated from moving to the protruding position by the sheet S passing through the sheet conveying path, and the lever 73 enters a state of waiting in the retracted position while being in contact with the surface of the sheet S. In FIG. 8A in which the holding member 71 is located in the first position, the abutment surface 73*a* of the lever member 73, which is in abutment with the surface of the sheet S, is located upstream of the nip of the conveying roller pair 34. Note that, as illustrated in FIG. 8B, also in this state, the light blocking flag 75*a* is separated from the optical path L of the optical sensor 75*b* so that the leading edge detecting portion is still in the state in which the light receiving portion receives the light emitted from the light emitting portion. In this state, the control portion of the image forming apparatus 1 determines that the sheet S is passing through the sheet conveying portion 3.

As illustrated in FIG. 9A, when the sheet S has passed the sheet conveying path (when a trailing edge of the sheet S has passed the nips N of the conveying roller pairs 34), the lever member 73 is returned to the protruding position by the urging force of the second urging spring 74, and thus the abutment surface 73*a* is located on the sheet conveying path. That is, the abutment surface 73*a* assumes a state of waiting in the home position HP for detecting a leading edge of a succeeding sheet. As illustrated in FIG. 9B, the holding member 71 and the lever member 73 are located in the home position HP, and hence the light blocking flag 75*a* blocks the optical path L of the optical sensor 75*b*, so that the leading edge detecting portion 75 enters again the state in which the light output from the light emitting portion is blocked. In this state, the control portion of the image forming apparatus 1 determines that the sheet S has passed the sheet conveying portion 3.

As described above, the image forming apparatus 1 according to the first embodiment detects the passage of the sheet S by bringing the sheet S into abutment with the abutment surface 73*a* of the lever member 73 to move the holding member 71 from the first position toward the second position together with the lever member 73. After that, when the leading edge of the sheet S is disengaged from the abutment surface 73*a* in a state in which the holding member 71 is in the second position, the holding member 71 returns to the first position and the lever member 73 waits in the retracted position until the sheet S passes the lever member 73. Thus, immediately after the sheet S passes the lever member 73, the lever member 73 can be returned to the home position HP in which the leading edge of the succeeding sheet S can be brought into abutment with the abutment surface 73*a*. With this, a time period between a time when the sheet S passes the lever member 73 and a time when the lever member 73 returns to the home position HP can be reduced. As a result, a sheet-to-sheet distance is prevented from increasing even at a higher sheet conveying speed, and hence higher throughput can be obtained.

Second Embodiment

Next, an image forming apparatus 1A according to a second embodiment of the present invention will be described with reference to FIGS. 10 to 14 as well as FIG. 1. The image forming apparatus 1A according to the second embodiment is different from the image forming apparatus 1 according to the first embodiment in that the lever member 73 is moved by being pressed against a pressing portion 35 as a pressing member when the holding member 71 is rotated to the second position. Thus, in the second embodiment, differences from the first embodiment, specifically, the structure configured to rotate the lever member 73 will be mainly described. Thus, the same components as those of the image forming apparatus 1 according to the first embodiment are denoted by the same reference symbols, and the descriptions thereof are omitted herein.

Figure 10:
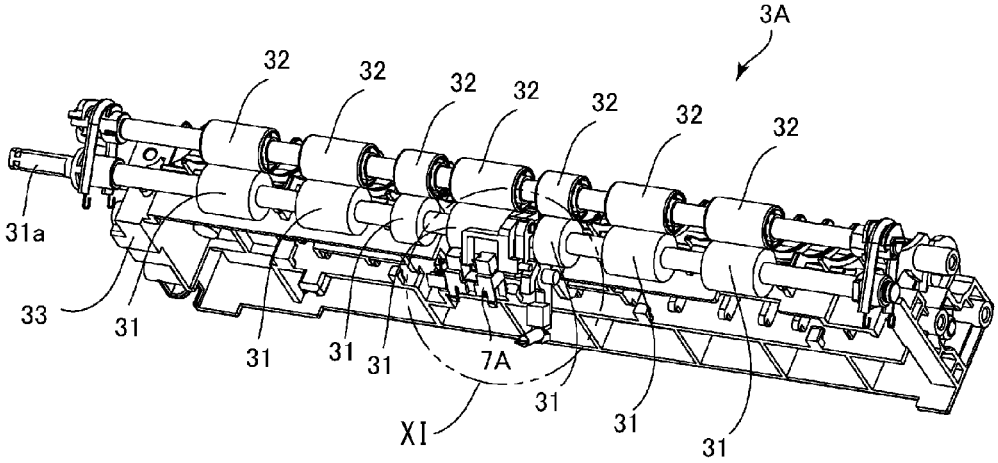
FIG. 10 is a perspective view illustrating a sheet conveying portion according to a second embodiment.
Figure 11:
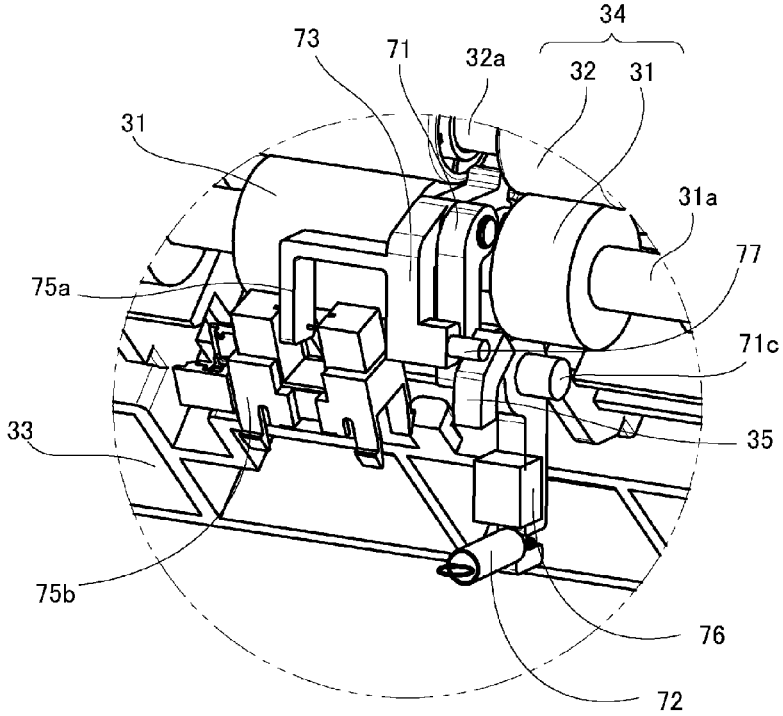
FIG. 11 is an enlarged view of the encircled portion XI of FIG. 10.

First, an overall structure of the image forming apparatus 1A according to the second embodiment will be described with reference to FIGS. 10 and 11 as well as FIG. 1. FIG. 10 is a perspective view of a sheet conveying portion 3A according to the second embodiment. FIG. 11 is an enlarged view of the encircled portion XI of FIG. 10.

As illustrated in FIG. 1, the image forming apparatus 1A according to the second embodiment includes the sheet feeding portion 2, the sheet conveying portion 3A, the image forming portion 4, the fixing portion 5, and the delivery portion 6. As illustrated in FIGS. 10 and 11, the sheet conveying portion 3A includes the plurality of conveying rollers 31, the plurality of conveying rotatable members 32, the feeding frame 33, a sheet detecting portion 7A, and the pressing portion 35. The sheet detecting portion 7A includes the holding member 71, the first urging spring 72, the lever member 73, the second urging spring 74, the leading edge detecting portion 75, the regulating member 76, and a pressed portion 77 connected to the lever member 73.

The pressing portion 35 includes a pressing surface 35*a* which is in contact with the pressed portion 77 when the holding member 71 is located in the first position and is configured to press the pressed portion 77 toward the retracted position in accordance with the movement of the holding member 71 to the second position. In other words, the pressing portion 35 and the pressed portion 77 serve as a cam mechanism configured to rotate the lever member 73 toward the retracted position.

Figure 12:
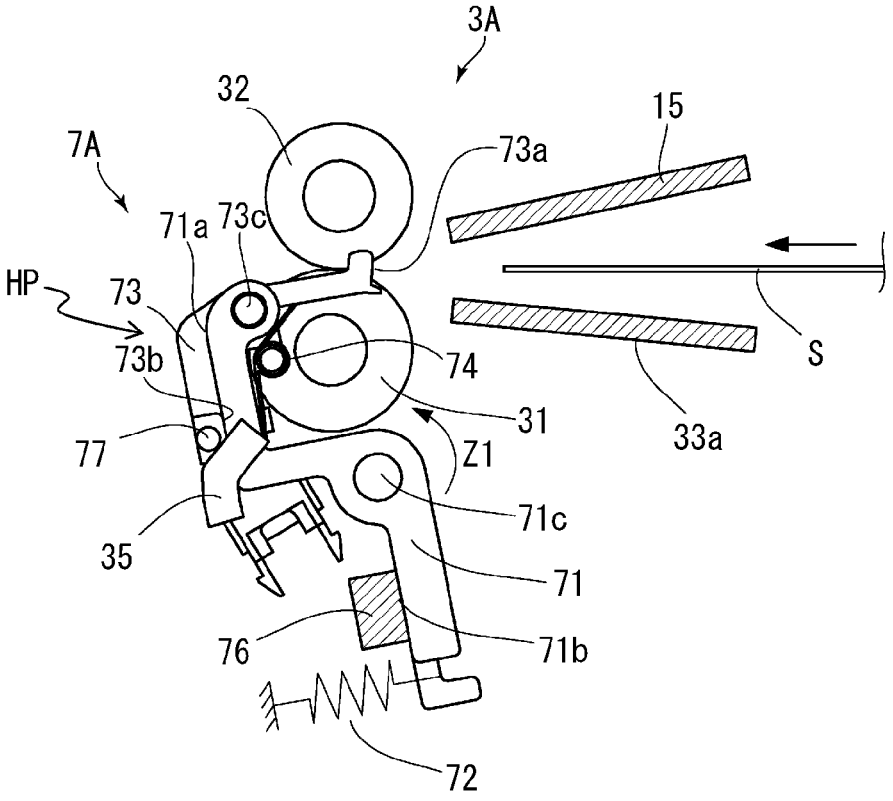
FIG. 12 is a sectional view illustrating a state in which the sheet enters the sheet conveying portion according to the second embodiment.
Figure 13:
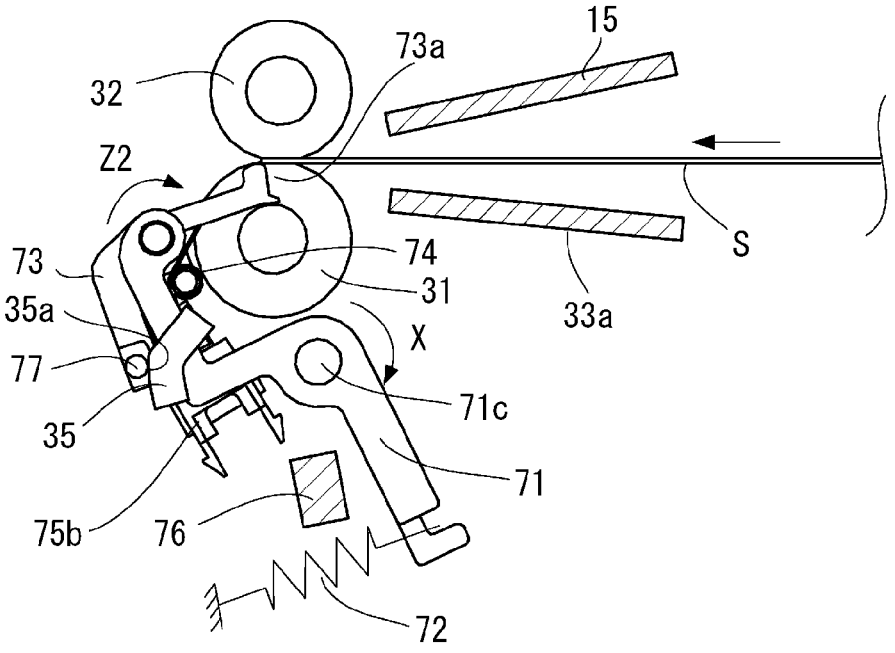
FIG. 13 is a sectional view illustrating a state in which the abutment surface is pushed by the sheet and the holding member configured to hold the lever member is rotated.
Figure 14:
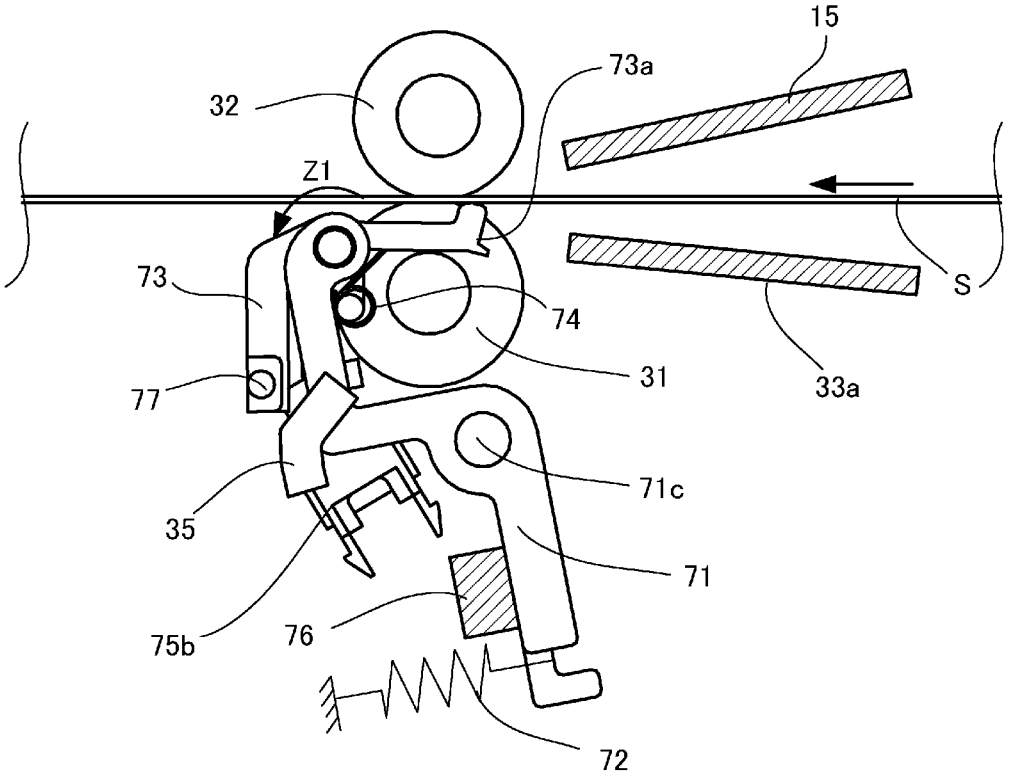
FIG. 14 is a sectional view illustrating a state in which the sheet is passing over the lever member retracted to the retracted position.
Figure 15:
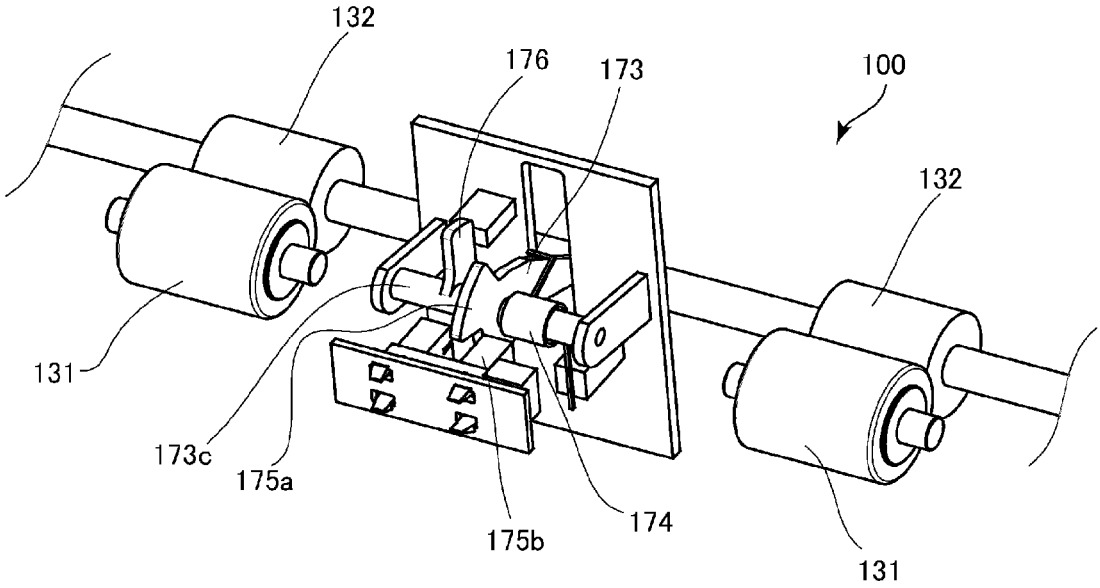
FIG. 15 is a perspective view illustrating a sheet detecting portion according to a conventional example.
Figure 16A:
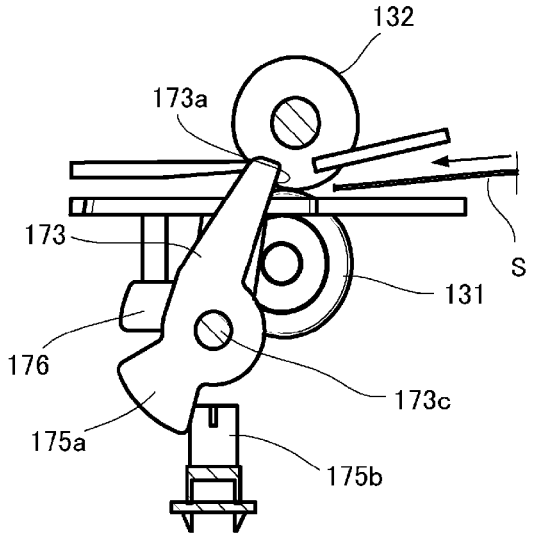
FIG. 16A is a sectional view illustrating a state in which the sheet enters the sheet detecting portion according to the conventional example.
Figure 16B:
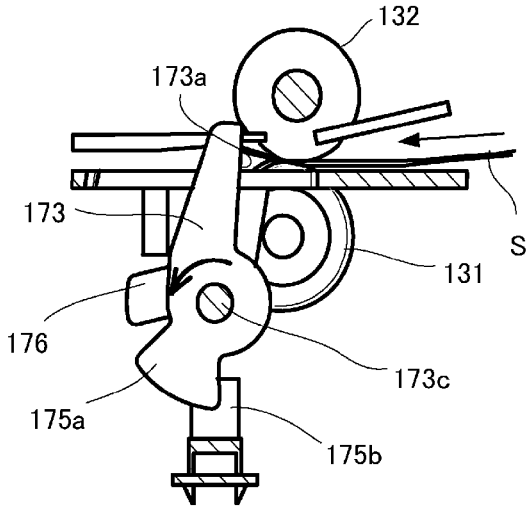
FIG. 16B is a sectional view illustrating a state in which an abutment surface is pushed by the sheet and a lever member is rotated.
Figure 16C:
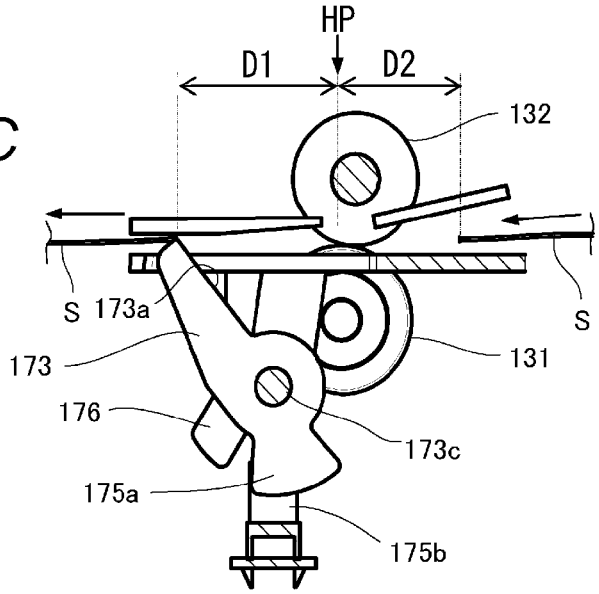
FIG. 16C is a sectional view illustrating a state in which the sheet has passed over the lever member.

Next, an operation of detecting the sheet S by the sheet detecting portion 7A of the image forming apparatus 1A according to the second embodiment will be described with reference to FIGS. 12 to 14. FIG. 12 is a sectional view illustrating a state in which the sheet S enters the sheet conveying portion 3A according to the second embodiment. FIG. 13 is a sectional view illustrating a state in which the abutment surface 73*a* is pushed by the sheet S and the holding member 71 configured to hold the lever member 73 is rotated. FIG. 14 is a sectional view illustrating a state in which the sheet S passes over the lever member 73 retracted to the retracted position.

As illustrated in FIG. 12, when the holding member 71 and the lever member 73 are located in the home position HP, the pressing portion 35 is in contact with the pressed portion 77 and the pressing portion 35 is in a state in which the pressing portion 35 does not press the pressed portion 77. In the state in which the holding member 71 and the lever member 73 are located in the home position HP, similarly to the first embodiment, the light blocking flag 75*a* blocks the optical path L of the optical sensor 75*b* so that the leading edge detecting portion 75 enters the state in which the light output from the light emitting portion is blocked.

In this state, when the sheet S enters the sheet conveying portion 3A, similarly to the first embodiment, the leading edge of the sheet S abuts against the abutment surface 73*a* of the lever member 73, and the abutment surface 73*a* is pushed by the sheet S so that the holding member 71 starts to rotate in the direction indicated by the arrow Z1 in FIG. 12 together with the lever member 73. When the holding member 71 starts to rotate together with the lever member 73, the light blocking flag 75*a* is separated from the optical path L of the optical sensor 75*b* in association with the movement of the lever member 73, and the optical path L is unblocked. Accordingly, the light receiving portion receives the light output from the light emitting portion. When the light receiving portion receives the light, the optical sensor 75*b* transmits a detection signal to the control portion (not shown), and the control portion controls the image forming portion 4 to start the image forming operation.

When the holding member 71 further rotates to the second position, the pressed portion 77 connected to the lever member 73 moves along the pressing surface 35*a* of the pressing portion 35, and accordingly the lever member 73 is pressed by the pressing portion 35 in the retracting direction through the pressed portion 77. As illustrated in FIG. 13, when the holding member 71 reaches the second position, the pressed portion 77 of the lever member 73 is pressed by the pressing portion 35 and the abutment surface 73*a* of the lever member 73 retracts from the sheet conveying path. Then, the leading edge of the sheet S passes beyond the top point of the abutment surface 73*a* so that the leading edge of the sheet S is disengaged from the abutment surface 73*a*.

When the leading edge of the sheet S is disengaged from the abutment surface 73*a*, the pushing force from the sheet S is eliminated so that the holding member 71 starts to rotate toward the first position, and the lever member 73 pressed by the pressing portion 35 through the pressed portion 77 moves toward the retracted position while being in contact with the surface of the sheet S. As illustrated in FIG. 14, when the holding member 71 returns to the first position, the lever member 73 is regulated from moving to the protruding position by the sheet S passing through the sheet conveying path, and therefore the lever member 73 assumes a state of waiting in the retracted position while being in contact with the surface of the sheet S. When the sheet S has passed the sheet conveying path (has gone past the nips N of the conveying roller pairs 34), the lever member 73 is returned to the protruding position by the urging force of the second urging spring 74, and thus the abutment surface 73*a* is located on the sheet conveying path. In other words, the holding member 71 and the lever member 73 assume the state of waiting in the home position HP for detecting a leading edge of a succeeding sheet. The holding member 71 and the lever member 73 are located in the home position HP, and hence the light blocking flag 75*a* blocks the optical path L of the optical sensor 75*b* so that the leading edge detecting portion 75 again enters the state in which the light output from the light emitting portion is blocked.

As described above, the image forming apparatus 1A according to the second embodiment includes the pressing portion 35 and the pressed portion 77. Thus, when the holding member 71 moves to the second position together with the lever member 73, the lever member 73 can reliably be rotated toward the retracted position.

The embodiments of the present invention are described above, but the present invention is not limited to the embodiments described above. Further, the advantages described in the embodiments of the present invention are merely described as most preferred advantages to be achieved by the present invention. Thus, the advantages of the present invention are not limited to those described in the embodiments of the present invention.

For example, in the embodiments of the present invention, the lever member 73 is held by the holding member 71 so as to be rotatable between the protruding position and the retracted position. However, the present invention is not limited thereto. For example, the lever member 73 may be held by the holding member 71 so as to pop up and down (slidably move) between the protruding position and the retracted position.

Further, as described in the embodiments of the present invention, the urging springs are used as the first urging unit and the second urging unit, but the present invention is not limited thereto. For example, the first urging unit and the second urging unit may include an elastic body configured to urge. Further, as described in the embodiments of the present invention, the light blocking flag 75*a* connected to the lever member 73 blocks the optical path L of the optical sensor 75*b*, but the present invention is not limited thereto. For example, the light blocking flag configured to block the optical path L of the optical sensor may be disposed on the holding member 71.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional of U.S. application Ser. No. 14/362,688, filed on Jun. 4, 2014, which is itself a National Stage Entry of PCT/JP2013/052782, which was filed on Jan. 31, 2013, and which claims the benefit of Japanese Patent Application No. 2012-025191, filed Feb. 8, 2012, which are both hereby incorporated by reference herein in their entireties.

REFERENCE SIGNS LIST

1, 1A, image forming apparatus
3, 3A sheet conveying portion
4 image forming portion
7, 7A sheet detecting portion (sheet detecting apparatus)
31 conveying roller
32 conveying rotatable member
35 pressing portion (pressing member)
71 holding member
72 first urging spring (first urging unit)
73 lever member
73*a* abutment surface
74 second urging spring (second urging unit)
75 leading edge detecting portion (detecting unit)
75*b* optical sensor (detection sensor)
S sheet

The invention claimed is:

1. A sheet conveying apparatus, comprising:

an abutment member including an abutment surface against which a leading edge of a sheet being conveyed abuts;

a holding member configured to hold the abutment member so as to be movable between an abutment position at which the leading edge of the sheet abuts against the abutment surface and a retracted position at which the leading edge of the sheet does not abut against the abutment surface, the holding member being movable together with the abutment member from a waiting position in a predetermined direction when the abutment surface of the abutment member is pushed by the leading edge of the sheet in a state in which the holding member is located at the waiting position;

a sheet conveying unit configured to convey the sheet in a state in which the abutment member contacts a surface of the sheet after the leading edge of the sheet comes off the abutment surface by the holding member being moved in the predetermined direction;

a first urging portion configured to urge the holding member so as to move the holding member to the waiting position in the state in which the abutment member contacts the surface of the sheet conveyed by the sheet conveying unit;

a second urging portion configured to urge the abutment member so as to move the abutment member, which is released from contact with the surface of the sheet conveyed by the sheet conveying unit, from the retracted position to the abutment position in a state in which the holding member is located at the waiting position; and a flag configured to move in association with movement of the abutment member in order to change detection of a detecting portion.

2. A sheet conveying apparatus according to claim 1, wherein the detecting portion comprises an optical sensor, and a state of the flag is switched, in association with the movement of the abutment member, between a transmission state in which the flag allows light of the optical sensor to be transmitted and a blocking state in which the flag blocks the light.

3. A sheet conveying apparatus according to claim 2, wherein the flag is in the blocking state in a case where the abutment surface is located at the abutment position and the flag is in the transmission state in a case where the abutment surface is located at the retracted position.

4. A sheet conveying apparatus according to claim 3, wherein the first urging portion urges the holding member so as to move the holding member in a direction reverse to the predetermined direction.

5. A sheet conveying apparatus according to claim 4, further comprising a stopper configured to position the holding member which is urged by the first urging portion so as to be moved in the reverse direction.

6. A sheet conveying apparatus according to claim 3, wherein the abutment member is rotatable about a first rotary shaft with respect to the holding member.

7. A sheet conveying apparatus according to claim 6, wherein the holding member is rotatable about a second rotary shaft different from the first rotary shaft.

8. A sheet conveying apparatus according to claim 3, wherein the abutment member is a first abutment member, and further comprising a second abutment member different from the first abutment member in a width direction intersecting with a sheet conveying direction, wherein the second abutment member is moved integrally with the first abutment member with respect to the holding member.

9. A sheet conveying apparatus according to claim 3, wherein the holding member comprises a positioning portion configured to position the abutment member, which is urged by the second urging portion, with respect to the holding member.

10. A sheet conveying apparatus according to claim 3, wherein an urging force of the first urging portion is greater than an urging force of the second urging portion.

11. A sheet conveying apparatus according to claim 10, wherein the first urging portion comprises a first spring.

12. A sheet conveying apparatus according to claim 11, wherein the second urging portion comprises a second spring.

13. An image forming apparatus, comprising:

an abutment member including an abutment surface against which a leading edge of a sheet being conveyed abuts;

a holding member configured to hold the abutment member so as to be movable between an abutment position at which the leading edge of the sheet abuts against the abutment surface and a retracted position at which the leading edge of the sheet does not abut against the abutment surface, the holding member being movable together with the abutment member from a waiting position in a predetermined direction when the abutment surface of the abutment member is pushed by the leading edge of the sheet in a state in which the holding member is located at the waiting position;

a sheet conveying unit configured to convey the sheet in a state in which the abutment member contacts a surface of the sheet after the leading edge of the sheet comes off the abutment surface by the holding member being moved in the predetermined direction;

a first urging portion configured to urge the holding member so as to move the holding member to the waiting position in the state in which the abutment member contacts the surface of the sheet conveyed by the sheet conveying unit;

a second urging portion configured to urge the abutment member so as to move the abutment member, which is released from contact with the surface of the sheet conveyed by the sheet conveying unit, from the retracted position to the abutment position in a state in which the holding member is located at the waiting position;

a flag configured to move in association with movement of the abutment member;

a detecting portion of which a detection result is changed by movement of the flag; and an image forming portion configured to form an image on the sheet conveyed by the sheet conveying unit.

* * * * *